United States Patent [19]

Magid

[11] 3,983,638

[45] Oct. 5, 1976

[54] COLLAPSIBLE HAIR DRYER DEVICE OR THE LIKE

[76] Inventor: Sidney Magid, 231-3 Chung Hsiao E. Road. Sec. 3, Taipei, China /Taiwan

[22] Filed: Feb. 27, 1975

[21] Appl. No.: 552,108

[52] U.S. Cl. ..... 34/99; 34/239

[51] Int. Cl.[2] ..... A45D 20/24

[58] Field of Search ..... 34/90, 91, 96–101, 34/151, 163, 234, 239, 240; 219/366–371; 132/7, 9

[56] References Cited

UNITED STATES PATENTS

| | | | |
|---|---|---|---|
| 2,504,394 | 4/1950 | Crafts | 34/99 |
| 2,630,634 | 3/1953 | Alvarez | 34/151 |
| 2,633,647 | 4/1953 | Jones | 34/99 |
| 3,032,891 | 5/1962 | Parker | 34/99 |
| 3,849,902 | 11/1974 | Clark, Jr. | 34/99 |

FOREIGN PATENTS OR APPLICATIONS

| | | | |
|---|---|---|---|
| 587,244 | 4/1925 | France | 34/99 |
| 1,067,853 | 5/1967 | United Kingdom | 34/99 |

*Primary Examiner*—Kenneth W. Sprague
*Assistant Examiner*—James C. Yeung
*Attorney, Agent, or Firm*—Roberts & Cohen

[57] ABSTRACT

A collapsible salon-type hair dryer or the like is provided with a collapsible umbrella-like frame adapted for being adjusted between collapsed and expanded conditions, a flexible body being supported thereon which is provided with an opening for the distribution of air to an inner chamber adapted to accommodate the head of a user. The frame can be locked in expanded condition and the dryer is supported in position for operation by a collapsible arm structure which is adapted to be stored in a case in which there may furthermore be accommodated a blower and a flexible tube for the supply of air.

3 Claims, 6 Drawing Figures

FIG. 1
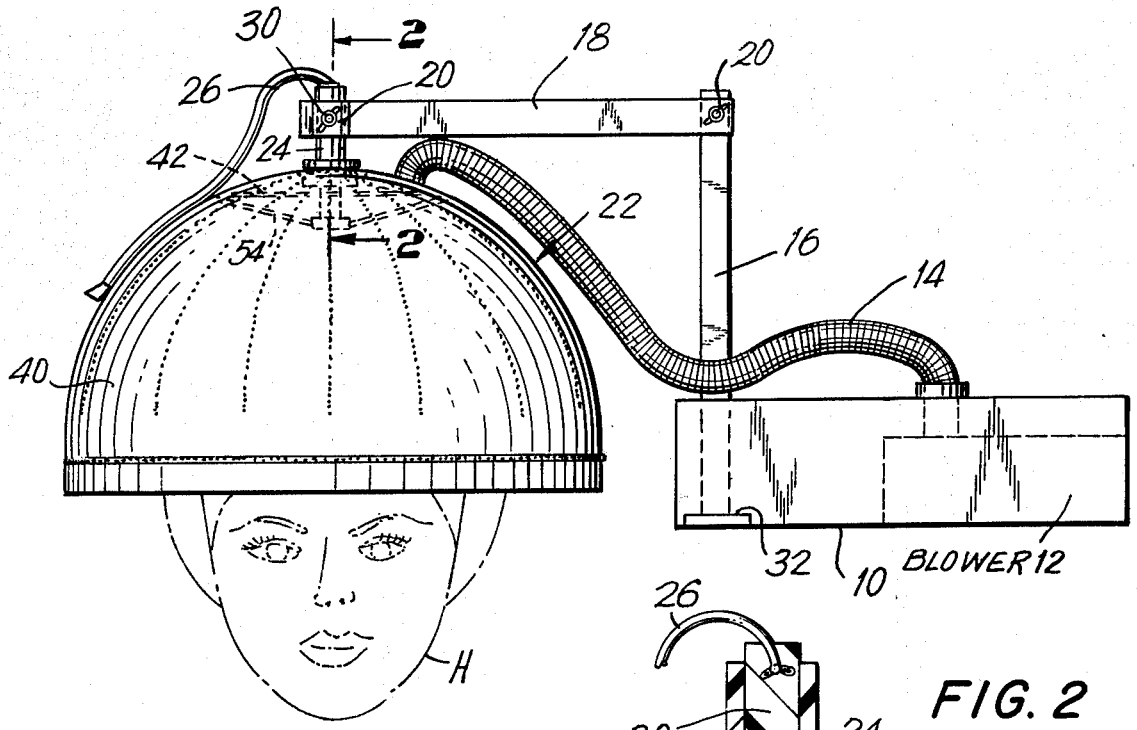
FIG. 2
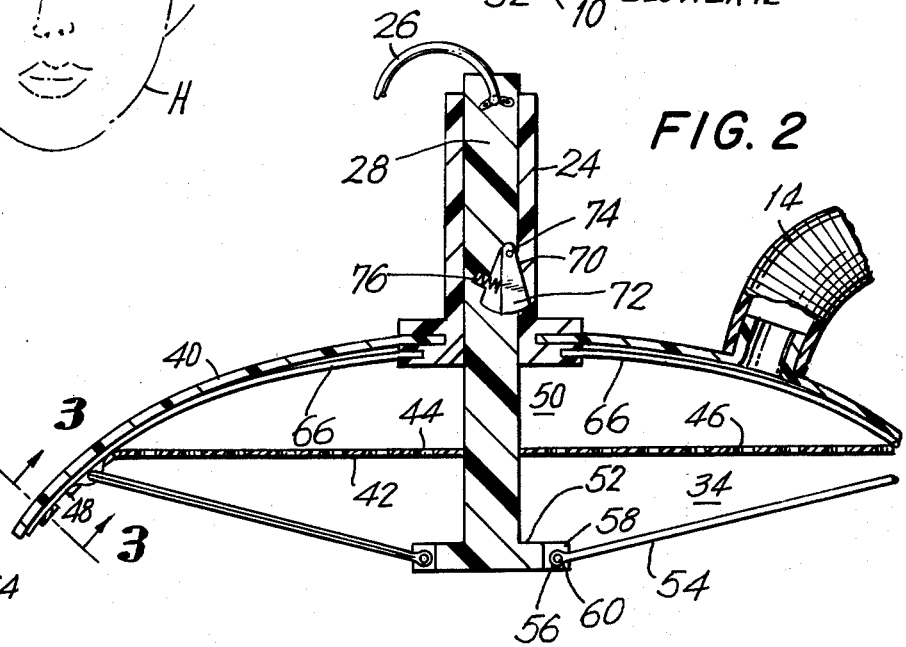
FIG. 4
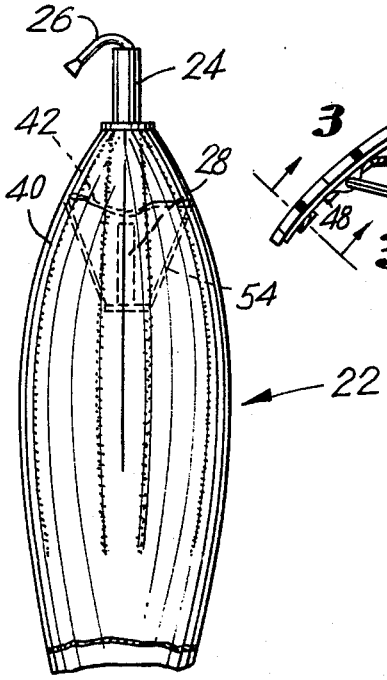
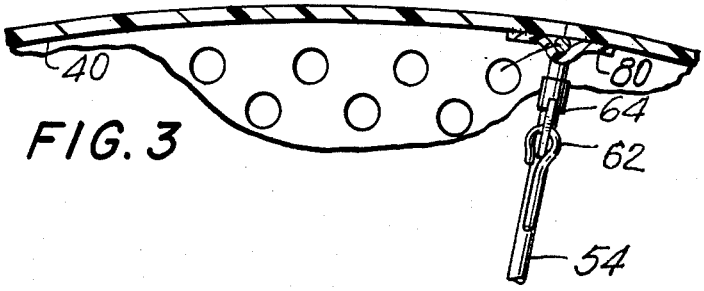
FIG. 3

COLLAPSIBLE HAIR DRYER DEVICE OR THE LIKE

FIELD OF INVENTION

This invention relates to devices for the distribution of pneumatic media and more particularly to collapsible salon-type hair dryers or the like of the portable type.

BACKGROUND OF INVENTION

Presently known salon-type hair dryers, both professional and those intended for home use, are generally all made from a rigid material. These known types of hair dryers are generally of bulky bubble-type constructions that require large volumes of space and are heavy and inconvenient to use. The known types of constructions are characteristically difficult to store and unwieldy to manipulate.

SUMMARY OF INVENTION

It is an object of the invention to provide an improved hair dryer or the like.

It is a further object of the invention to provide an improved hair dryer or like structure which is of collapsible form and which involves the use of a collapsible frame.

Yet another object of the invention is to provide an improved salon-type hair dryer which is readily brought to operational attitude and which is susceptible of mass manufacturing techniques at relatively low cost.

To achieve the above and other objects of the invention, there is provided an apparatus comprising a flexible body adapted for assuming a collapsed shape and an expanded shape and, in expanded shape, defining an interior chamber adapted for the accommodation of an article such as the head of a user. The aforementioned body includes means for the receipt and distribution of a mobile medium such as air and it is provided with openings for discharging this medium into said chamber and thereby at and around the head of the user. A collapsible frame is provided which is operatively associated with the flexible body to control bringing the same into one of the aforementioned shapes.

In accordance with the invention, the aforementioned body may include one or more surface members and the frame may include articulated struts connected to one of said members.

According to a feature of the invention, the flexible body and frame are expandible into an expanded shape of domelike form which is the usual form of the salon-type hair dryer.

According to still another feature of the invention, the aforesaid frame means may include lock means to lock the frame into a shape in which the flexible body is held in expanded form.

In further accordance with the invention, there may be provided a source of mobile or pneumatic medium and a flexible hose coupling this source to the means for the receipt and distribution of the mobile medium. A case may be provided for housing this source and a collapsible arm may be provided for supporting the body and frame means in an operative position for use, the arm being storable in said case.

In further accordance with the invention, the body may include a flexible shape defining member and the means for the receipt and distribution of the mobile medium may include at least one element affixed to the shape defining member to form a unit provided with a plurality of openings.

According to another embodiment of the invention, the aforesaid body may include a flexible shape defining member and said means for the receipt and distribution of said mobile medium may include a disc-like member connected to said shape defining member and provided with a plurality of openings opening into the aforementioned interior chamber.

According to still another embodiment of the invention, the aforesaid body and the means for the receipt and distribution of said mobile medium may collectively include two walls connected together at spaced positions to define a manifold chamber, one of these walls being provided with openings which open into the interior chamber.

The frame means provided in accordance with the invention may include first and second parts adapted for telescopic engagement, a first plurality of struts being pivoted to the first part and coupled to the body for shaping the latter. A second plurality of struts may be provided which is coupled pivotally to the second said part and is pivotally and slidably coupled to said first plurality of struts to move the latter between collapsed and extended states. The first part may be a cylindrical part and there may be provided a flexible line coupled to the second part and extending through the first part to draw the second part into the latter.

According to the invention, the means for the receipt and distribution of mobile medium may be of a construction to provide a single continuous manifold chamber.

Advantageously, the body referred to above may be of at least one piece including a base portion and a plurality of generally triangle portions extending in parallel from the base portion and connected in edge to edge relation to form at least part of a dome.

The frame means may be coupled to the body by loops or the like.

The above and other objects and features of the invention may be found in the detailed description which follows hereinafter.

BRIEF DESCRIPTION OF DRAWING

In the drawing:

FIG. 1 is a front view of a hair dryer construction provided in accordance with the invention;

FIG. 2 is a sectional view taken along line 2—2 of FIG. 1;

FIG. 3 is a sectional view taken along the line 3—3 of FIG. 2;

FIG. 4 is a front view illustrating the hair dryer of FIG. 1 in collapsed condition;

DETAILED DESCRIPTION

Figure 5:
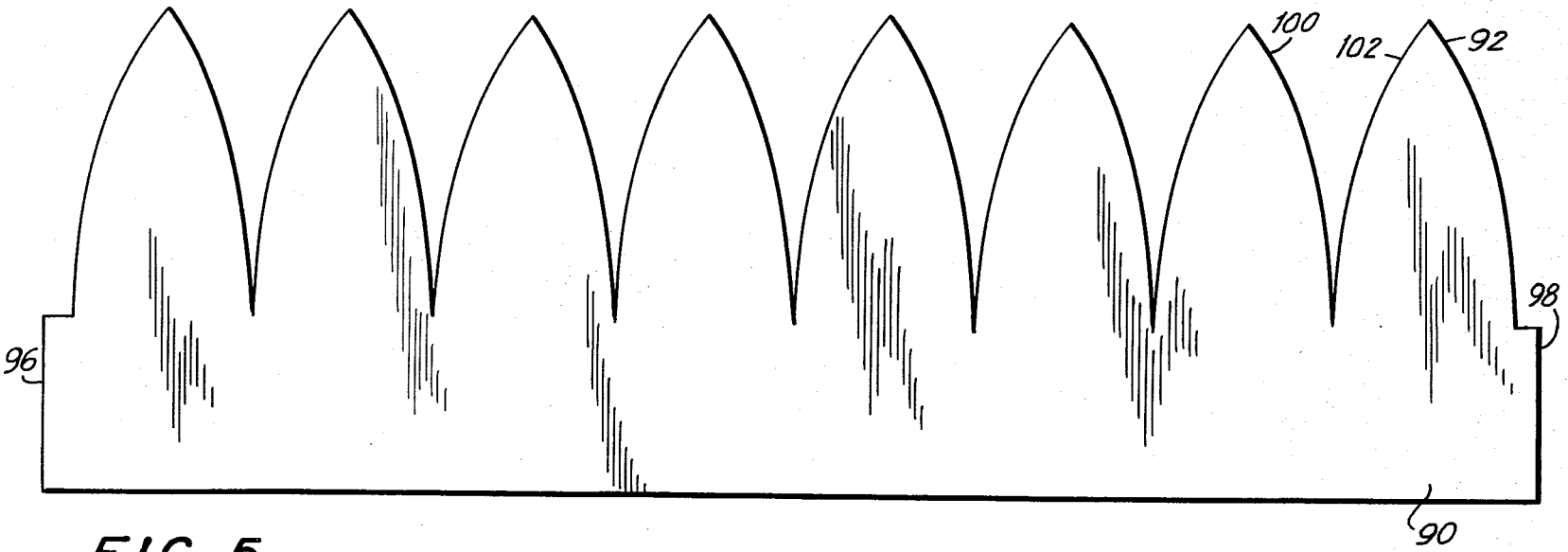
FIG. 5 is a plan view of a blank manifold which can be fashioned into the dome-like form illustrated in FIG. 1, all in accordance with the invention.

As has been indicated hereinabove, the invention provides an apparatus comprising a flexible body adapted for assuming a collapsed shape and an expanded shape and in expanded shape defining an inner chamber adapted for the accommodation of an article such as the head of a user. The body includes means for the receipt and distribution of a mobile or pneumatic medium such as hot air and is provided with openings for discharging this medium into the inner chamber and thereby at and around the head of the user. In accordance with the invention, a collapsible frame is operatively associated with the flexible body to control bringing the same into collapsed or expanded shape.

In FIG. 1 appears a case 10 in which is stored and accommodated a blower 12 constituting a source of hot air or other mobile or pneumatic medium adapted for being transmitted through the flexible hose 14 which is also capable of being stored in the case 10.

A collapsible arm structure is provided which includes an arm section 16 and a further arm section 18 pivoted to arm section 16 by a pin indicated at 20. The arm section 18 includes a cylindrical portion 20 from which is suspended the salon-type hair dryer 22 of the invention and the details of which will be described hereinbelow.

FIG. 4 illustrates the hair dryer 22 in collapsed condition. It will be seen in this figure that the hair dryer 22 includes a first part 24 of a telescopic arrangement, the part 24 being a hollow cylinder through which extends the flexible line 26. A second part 28 constitutes the other part of the telescopic arrangement. The flexible line 26 is connected to the part 28 to provide for drawing the part 28 upwardly into telescopic relationship with the first part 24.

The part 24 is accommodated within the cylindrical part 20 on the arm 18 and can be locked into the cylindrical part 20 by means of a locking screw 30. This enables the hair dryer 22 to be held in position by the collapsible arm structure which is itself adapted for being supported in a receptacle 32 provided in the case 10. The case 10 which may be fabricated of plastic, wood, metal or the like is of such a size as to be able to accommodate and store the collapsed arm structure and the collapsed hair dryer 22 along with the blower 12 and the hose 14.

In FIG. 1 is illustrated the head H of the user. This head H may be considered to be generally an article adapted to be accommodated within an inner chamber 34 defined by the dome-like body structure constituting an essential part of the hair dryer 22. To this end, the hair dryer 22 comprises a body which includes a flexible member 40 which in accordance with the invention is capable of assuming collapsed or expanded states in the latter of which the inner chamber 34 is defined.

Peripherally fixed to the flexible member 40 is a flexible perforated sheet-like member 42 having air distribution openings such as indicated at 44 and 46. This member 42 defines an air distribution chamber 50 which provides for the receipt and distribution of hot air or the like which escapes from chamber 50 through the openings 44 and 46 into the interior chamber 34 and is thereby directed at and around the head of the user.

FIG. 2 illustrates in greater detail the parts 24 and 28 of the telescopic arrangement. It will be seen that the flexible line 26 is connected to the top of the inner member 28 which includes a disc-like base portion 52 to which are pivoted a plurality of horizontal struts such as indicated for example at 54. These struts include end portions 56, fit into slots 58 provided in the periphery of the disc 52 to accommodate pins 60, which provide for a pivoting of the struts 54. As indicated more particularly in FIG. 3 the outer extremities of the struts 54 are fashioned in the form of hooks 62 connected in eye members 64 provided on slides 48 which are slidably coupled to respective of a second plurality of struts such as indicated, for example, at 66. The latter struts are adapted to assume expanded and collapsed conditions by means of which the collapsed form of FIG. 4 is assumed by the hair dryer or by means of which the expanded condition of the hair dryer such as indicated in FIG. 1 is assumed. The struts 54 and 66 thereby constitute a plurality of articulated struts in generally umbrella-like form by means of which the collapsed or expanded conditions of the hair dryer are controllably selected.

The part 24 of the telescopic arrangement is provided with a lock receptacle 70 into which pivots the lock member 72 which is pivotally connected at 74 to the part 28. A spring 76 provides for spring loading the lock member 72 to urge the latter into the lock receptacle.

As can be best seen in FIG. 3, the struts 66 may be connected to the flexible body portion 40 by means of loops such as indicated at 80. A plurality of such loops may be provided. These loops may also be provided in the form of strips which extend horizontally along the hair dryer construction illustrated in FIG. 1. Alternatively, the struts 66 may be heat sealed directly to the body element 40 by means of the application of high frequency heating or the like. Preferably, the struts 66 are coupled to the body element 40 but this is not necessarily the case in all embodiments of the invention inasmuch as the expansible frame construction may within the scope of the invention be entirely disconnected from the collapsible body.

It is to be noted that generally the flexible and collapsible body of the invention is, in the illustrated embodiment, in the form of a monolithic structure involving the use of a single continuous wall within which is provided a chamber for the supply and distribution of hot air. It is contemplated, however, within the scope of the invention that the body may be provided in two or more sections as well, these sections being operatively associated with each other and with the collapsible frame in order to constitute a hair dryer construction embodying most if not all of the advantages of the arrangement which appears in FIG. 1.

FIG. 5 illustrates a monolithic type of blank which may be employed to result in the structure generally described hereinabove. The blank in FIG. 5 comprises a base section 90 and a plurality of generally triangular sections 92 extending upwardly therefrom. The triangular sections 92 are generally parallel and integral with the base section 90 forming therewith a flat sheet-like arrangement of a flexbile plastic such as vinyl plastic to which the loop members may be attached.

With respect to manufacture, the extremities 96 and 98 are connected together to form an endless ring such as by bonding or high frequency welding. The form and style of the connection of extremities 96 and 98 do not particularly form a feature of the instant invention.

When the ends 96 and 98 are joined together or held in abutting relationship, the edges 100 and 102 of each of the triangular sections will be brought together also into abutting relationship. These edges may then be connected by means of an adhesive or by means of heat sealing or by any other conventional means by which plastic sheet elements are brought together and held together in edge to edge abutting relationship. The bringing of these edges into abutting and connected relationship will operate to form the dome-like structure which appears in FIG. 1.

Figure 6:
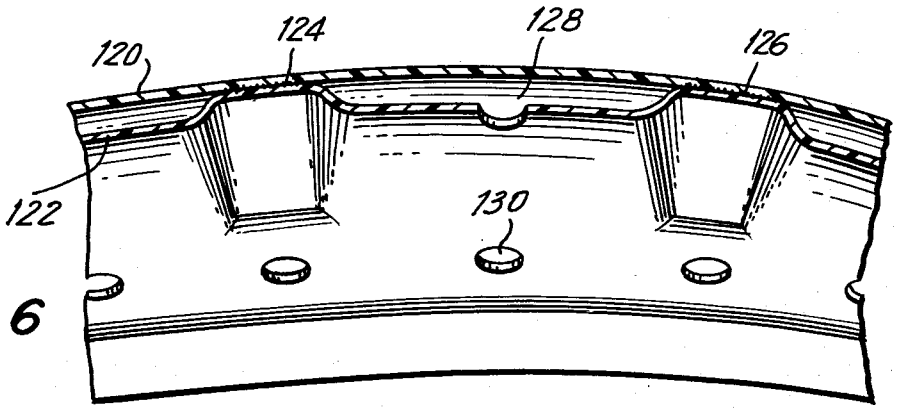
FIG. 6 illustrates in sectional view a form of manifold construction which may be employed in accordance with the invention.

FIG. 6 illustrates another possibility in which the hair dryer body is provided with two flexible sheets such as indicated at 120 and 122, these being connected together at spaced positions indicated by way of example at 124 and 126. The connection of the two sheets together at spaced points permits the formaction of manifold chambers such as indicated at 128 for the receipt and distribution of hot air which is allowed to escape through openings 130 in the innermost of the two flexible sheets whereby hot air is directed at and against the head of the user.

In the above description, the parts 24 and 28 of the telescopic arrangement may be fabricated of synthetic materials such as plastic and the like but may alternatively be formed of other materials such as, for example, hard natural rubber or wood or metal. The struts 54 and 66 are preferably fabricated of metal but may also be fabricated of any other material having suitable strength, including but not limited to suitable copolymers. The parts 24 and 28 are sufficiently short as to avoid extending substantially into chamber 34 whereby to avoid contact with the head of the user. Preferably, part 28 will not extend more than about two inches into chamber 34.

The flexible body employed in accordance with the invention and adapted for assuming collapsed and expanded shapes may be fabricated of a heat sealable plastic material such as vinyl plastic but may also be fabricated of other materials both natural and synthetic such as, for example, natural and synthetic rubbers. The flexbile line or cord 26 may be formed of nylon or the like.

There will now be obvious to those skilled in the art many modifications and variations of the structure set hereinabove. These modifications and variations of the structure will not depart from the scope of the invention if defined by the following claims.

What is claimed is:

1. Apparatus comprising a flexible body adapted for assuming a collapsed shape and an expanded shape and, in expanded shape, defining a chamber adapted for the accommodation of an article, said body including means for the receipt and distribution of a mobile medium and being provided with at least one opening for discharging said medium into said chamber and thereby at and around said article, and collapsible frame means operatively associated with said flexbile body to control bringing the latter into one of said shapes, said frame means including first and second parts adapted for telescopic engagement, a first plurality of struts mounted on said first part and coupled to and extending along said body for shaping the latter, and a second plurality of struts coupled pivotally to said second part and pivotally and slidably coupled to said first plurality of struts to move the latter between collapsed and extended states, said second part normally extending out of said first part but being displaceable into said first part to operate the second plurality of struts to move the first plurality of struts to extended state and thereby bring the flexible body into expanded shape, said first plurality of struts in collapsed state encircling and extending along said second part.

2. Apparatus as claimed in claim 1, wherein said first part is a cylindrical part, comprising a flexible line coupled to said second part and extending through the first part to draw the second part into the latter.

3. Apparatus as claimed in claim 2 wherein said second part is sufficiently short as to avoid extending substantially into said chamber with the plurality of struts in extended condition.

* * * * *